US007047697B1

(12) United States Patent
Heath

(10) Patent No.: US 7,047,697 B1
(45) Date of Patent: May 23, 2006

(54) MODULAR DECKING PLANKS

(75) Inventor: Randall Heath, Pinson, AL (US)

(73) Assignee: Homeland Vinyl Products, Inc., Pinson, AL (US)

( * ) Notice: Subject to any disclaimer, the term of this patent is extended or adjusted under 35 U.S.C. 154(b) by 0 days.

(21) Appl. No.: 10/721,371

(22) Filed: Nov. 25, 2003

(51) Int. Cl.
*E04B 5/02* (2006.01)
*E04C 3/00* (2006.01)

(52) U.S. Cl. ..... 52/177; 52/483.1; 52/592.1; 52/591.4; 52/574

(58) Field of Classification Search ..... 52/177, 52/180, 181, 579, 574, 591.4, 592.1, 480, 52/506.1, 732.1, 483.1, 536; D25/125
See application file for complete search history.

(56) References Cited

U.S. PATENT DOCUMENTS 3,385,182 A * 5/1968 Harvey ..... 404/35
4,266,381 A 5/1981 Deller
4,522,007 A * 6/1985 Oehlert ..... 52/506.1
5,050,362 A 9/1991 Tal et al.
5,185,193 A * 2/1993 Phenicie et al. ..... 428/57
5,204,149 A * 4/1993 Phenicie et al. ..... 428/57
5,247,772 A * 9/1993 Greenberg ..... 52/531
5,535,567 A * 7/1996 Cahoon ..... 52/520
5,647,184 A 7/1997 Davis
5,758,467 A 6/1998 Snear et al.
5,811,035 A * 9/1998 Mockry ..... 261/111
5,816,010 A * 10/1998 Conn ..... 52/588.1
5,819,491 A 10/1998 Davis
6,199,240 B1 * 3/2001 You ..... 15/121
6,324,796 B1 * 12/2001 Heath ..... 52/177
6,516,577 B1 * 2/2003 Pelfrey et al. ..... 52/302.1
6,637,163 B1 * 10/2003 Thibault et al. ..... 52/177
D485,621 S * 1/2004 Deel ..... D25/119
6,729,097 B1 * 5/2004 Patel et al. ..... 52/665
6,739,106 B1 * 5/2004 Curatolo ..... 52/592.1
D492,797 S * 7/2004 Simko et al. ..... D25/125

* cited by examiner

*Primary Examiner*—Robert Canfield
(74) *Attorney, Agent, or Firm*—Smith, Gambrell & Russell, LLP

(57) ABSTRACT

A decking system for placement on a subassembly having at least two spaced apart joists. A plurality of tubular elements for placement in lateral interlocking engagement with each other transversely of and spanning the distance between the joists. Each of the elements has a top portion, a bottom portion, and first and second side walls connecting said top and bottom portions. The top portion extends laterally beyond the first side wall and has formed thereon a downwardly extending longitudinal flange. The bottom portion extends laterally beyond the second side wall and has formed thereon an upwardly extending longitudinal wall defining an upwardly opening channel adjacent the second side wall adapted to receive therein in watertight relation the downwardly extending longitudinal flange. The bottom wall extends past the longitudinal flange, with the bottom portion having formed therein a plurality of apertures proximate the second side wall to receive fasteners engaging the joists.

10 Claims, 3 Drawing Sheets

MODULAR DECKING PLANKS

FIELD OF THE INVENTION

The present invention relates generally to construction materials and more particularly to materials used for indoor and outdoor decking. In even greater particularity the present invention relates to the use of prefabricated decking planks and in still greater particularity to decking planks made from extruded materials. The invention is applicable, for example, in the construction of boat docks, piers, decks, patios, walkways, pontoon boat floors, and the like.

BACKGROUND OF THE INVENTION

Extruded polyvinyl building and construction materials are increasing in popularity due to their light weight, which greatly simplifies shipping, handling and installation, and also due to their durability in adverse weather conditions, which greatly increases their service life. Polyvinyl materials do not need to be periodically painted or preserved, which greatly lowers maintenance costs, and modern ultraviolet inhibitors prevent UV breakdown of polyvinyl materials for many years. Extruded hollow members offer utility similar to wood or molded members but are cheaper and easier to mass-produce than conventional molded members; and, extruded members can be easily formed with internal reinforcing ribs or webs to add strength and stiffness. As such, the hollow extruded members offer a long lasting, low maintenance, and cost effective alternative for traditional wood floor members, such as on decks, floors, porches, marine docks and similar applications.

Because nails or screws driven directly through the plastic are likely to cause stress risers and/or cracking, the hollow extruded members require special mounting brackets or cleats in order to secure the members to the supporting frame or structure.

On certain polyvinyl decking systems, the decking members have a series of openings in the bottom surface, and the members are snapped onto mounting brackets or clips that have been attached to the top of the joist or support structure. Another prior art approach utilizes U-shaped mounting clips that are attached to the top of the joist. The decking members are secured to the upwardly extending legs of the mounting clip. Such prior art systems have a number of drawbacks, including relatively high material costs and relatively long installation time, and on many such systems it is difficult to properly align the holes in the deck members with the preinstalled clips. Moreover, if the pre-installed clips are not mounted properly the decking members may move or "wander" slightly, giving the deck an unsightly and unprofessional appearance.

According to one prior art plastic decking plank, separate cap and base elements are snapped together to form a single plank. The base element is first mounted directly to the subfloor with fasteners such as screws or nails. Mating components of the cap and base elements are then manually aligned, and a rubber hammer or other tool is used to snap-attach the pieces together. Unlike the invention, such two-piece designs generally require substantial time and effort to assemble.

Another drawback with prior art methods is that polyvinyl, like all construction materials, flexes slightly under load. On conventional wood decks such flexing is almost completely unnoticeable. However, on plastic or polyvinyl decks such flexing often creates an unnerving and unpleasant squeak or creaking sound. For many reasons, most consumers consider such squeaking and creaking a very undesirable attribute. Accordingly, there exists a need for an improved polyvinyl decking system that is cost effective to produce and install, and that does not have any of the unfavorable characteristics that plague prior art polyvinyl decking systems. Further, known polyvinyl decking has a tendency to deform along reinforcement lines, thus creating unsightly rows along the plank.

The present invention utilizes extruded tubular decking members that have internal reinforcing webs to maximize flexural strength and stiffness. The present invention also utilizes a unique interlocking feature between adjacent decking members and maintains the proper spacing between deck members and also secures the deck members to each other and to the supporting joists.

SUMMARY OF THE INVENTION

The present invention provides a decking system for placement on a subassembly that provides a substantially watertight surface above the subassembly. The decking system includes a plurality of elongated tubular elements for placement in lateral interlocking engagement with each other transversely of and spanning the distance between the joists. Each of the elements has a top portion, a bottom portion, and first and second side walls connecting the top portion with the bottom portion. The top portion extends laterally beyond the first side wall and has a downwardly extending longitudinal flange formed at one end. The bottom portion extends laterally beyond said second side wall and has an upwardly extending longitudinal wall defining an upwardly opening channel adjacent. The second side wall is adapted to receive therein in watertight relation said downwardly extending longitudinal flange. The bottom portion additionally includes a series of apertures traversing the bottom portion proximate the upwardly extending longitudinal wall. Finally, a plurality of fasteners are included in the present invention that traverse the apertures to engage the elements with the subassembly.

BRIEF DESCRIPTION OF THE DRAWINGS

The system embodying the present invention is depicted in the accompanying drawings that form a portion of the invention and wherein.

DESCRIPTION OF THE PREFERRED EMBODIMENTS

Figure 1:
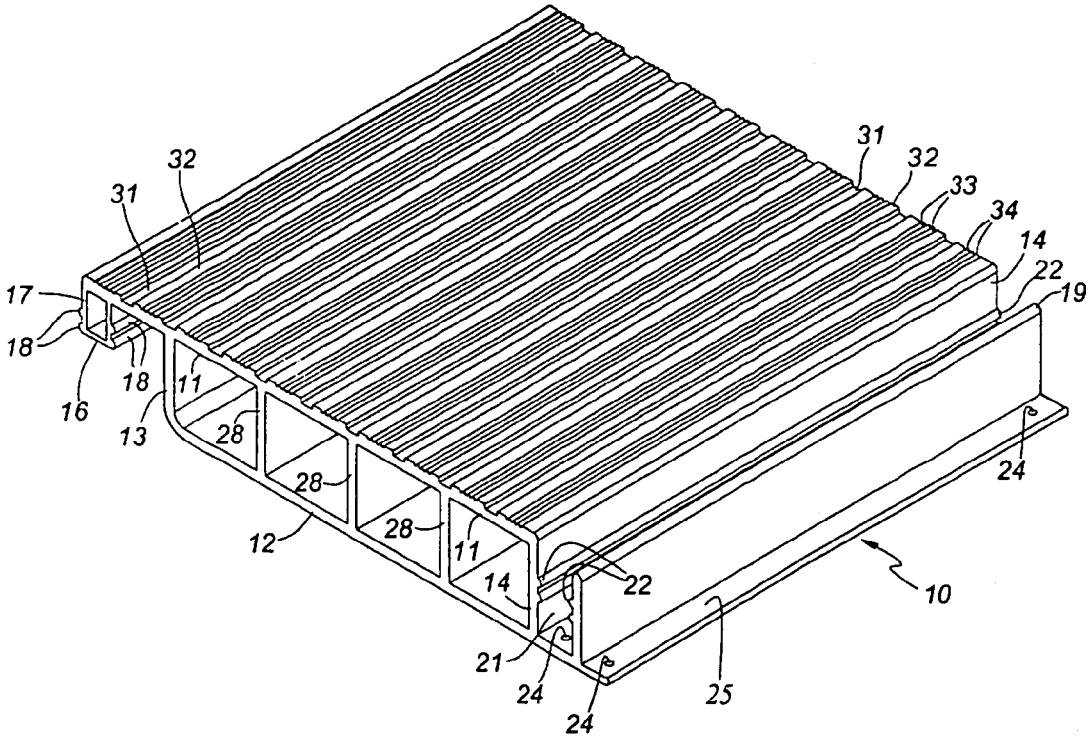
FIG. 1 is a perspective view of a deck plank made in accordance with the present invention.

Referring to the drawings for a clearer understanding of the present invention it may be seen in FIG. 1 that the present invention contemplates an elongated extruded construction element 10 or plank having a top wall portion 11, a bottom wall portion 12, a first side wall 13 connecting the top wall portion 11 and the bottom wall portion 12, and a second side wall 14 additionally connecting the top wall portion 11 and the bottom wall portion 12. The construction element 10 is preferentially extruded from PVC or some other suitable plastic; however, aluminum extrusion of the construction element 10 is also possible.

Top wall portion 11 extends laterally from the second side wall 14 past first side wall 13 and terminates in a downwardly extending flange 16. The downwardly extending flange 16 may include a pair of flange walls 17 on which a set of longitudinally extending ribs 18 are formed in spaced relation to one another. The bottom wall portion 12 extends laterally from the first side wall 13 past second side wall 14 to an upstanding longitudinal wall 19. The second side wall 14 and the upstanding longitudinal wall 19 form an upwardly opening channel 21. The bottom wall portion 12 further extends past the upstanding longitudinal wall 19, providing an additional ridge or ledge 25.

Figure 3:
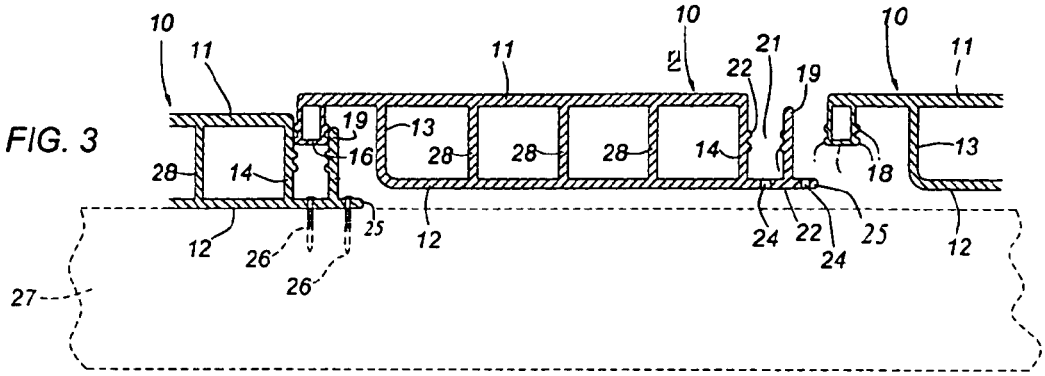
FIG. 3 is a sectional view of a plurality of planks being installed.
Figure 4:
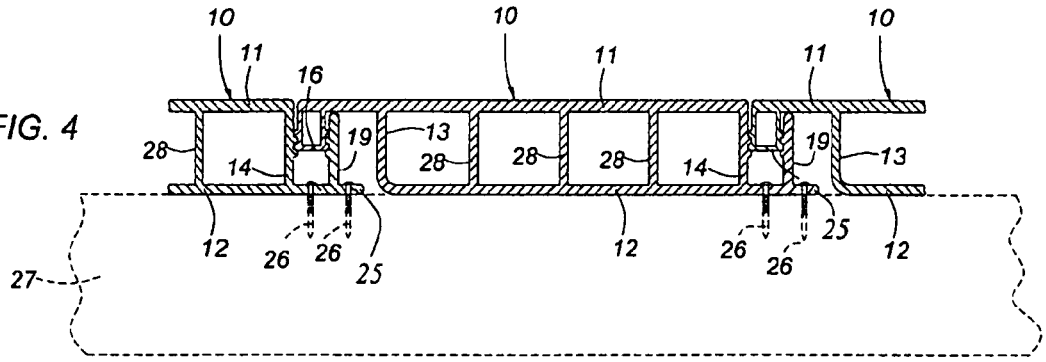
FIG. 4 is a sectional view of the installed planks.

A set of complementary elongated ribs 22 are formed on the second side wall 14 and the upstanding longitudinal wall 19 within channel 20. As may be seen in FIGS. 3 and 4, the ribs 18, 22 carried by the flange 16 and the channel 20 mate to form a watertight seal between adjacent plank elements 10.

Figure 2:
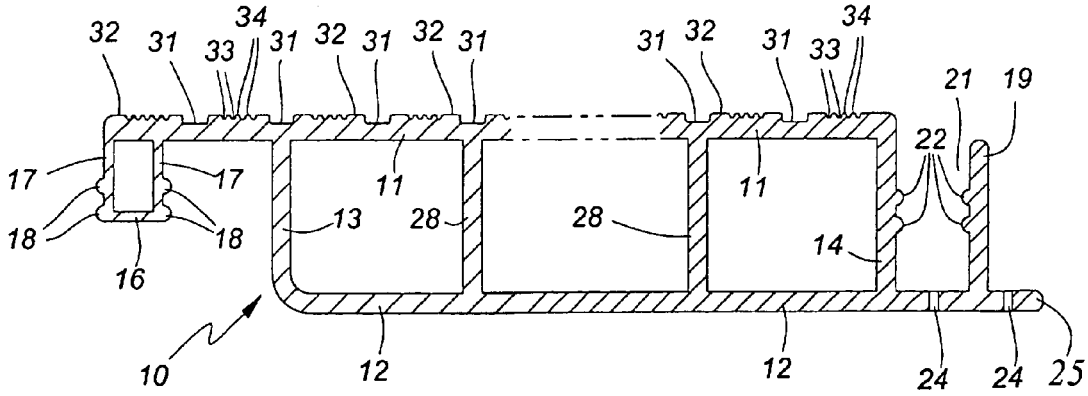
FIG. 2 is a partial section view of FIG. 1.

As may be seen in FIG. 2, one or more apertures 24 are formed in bottom wall portion 12 within the channel 21 to permit the use of fasteners 26 (such as screws) to engage a subassembly 27 beneath the construction elements 10. Moreover, to improve the security and the stability of the construction elements 10, the ledge 25 may instead include one or more apertures 24 that extend therethrough. The apertures 24 positioned on the ledge 25 provide a reinforced connection between the plank elements 10 and the subassembly 27, thereby adding to the stability of the plank elements 10 for the persons walking on these plank elements 10. These apertures 24 are therefore protected from water and corrosion by the top wall portion 11. The subassembly 27 may be a frame with joists or simply a subjacent surface.

To provide an attractive and functional upper surface, the top wall portion 11 of each plank is extruded with a series of lands and crests, including a plurality of parallel major lands 31 separated by major crests 32. The lands and crests generally have a longitudinal orientation on the top wall portion 11. Formed on the top of major crests 32 are a series of minor lands 33 and minor crests 34, shown as three lands and three crests in the preferred embodiment. Laterally of the minor lands and adjacent the major lands the major crests are flat or planar. This tread pattern disguises the stress pattern caused by a plurality of longitudinally extending internal walls 28 by placing the major lands directly over the internal walls and first end wall 13. The internal walls 28 are about 0.120 inches wide whereas the major lands are about 0.159 inches wide. The distance from crest to root of the adjacent minor lands and crests is 0.030 inches, with the major lands measuring 0.6075 from center to center. Internal walls are spaced 1.215 inches apart and the width of the plank is 5.95 inches. The crests and lands provide excellent drainage, traction and appearance for the polyvinyl deck.

Thus, although there have been described particular embodiments of the present invention of a new and useful IMPROVED MODULAR DECKING PLANKS, it is not intended that such references be construed as limitations upon the scope of this invention except as set forth in the following claims.

I claim:

1. A decking system for placement on a subassembly, said decking system comprising:

a plurality of elongated tubular elements for placement in lateral interlocking engagement with each other transversely of and spanning the distance of the subassembly, each of said plurality of tubular elements having a top portion, a bottom portion, a first side wall, and a second side wall connecting said top portion with said bottom portion;

wherein said top portion extends laterally from said second sidewall beyond said first side wall, said top portion having formed thereon a downwardly extending longitudinal flange;

wherein said bottom portion extends laterally from said first sidewall beyond said second side wall, said bottom portion having formed thereon an upwardly extending longitudinal wall defining an upwardly opening channel adjacent said second side wall, said upwardly opening channel adapted to receive therein in watertight relation a downwardly extending longitudinal flange formed on an adjacent tubular element;

a plurality of fasteners extending through said bottom portion on either side of said longitudinal wall for engagement with the subassembly.

2. A decking system for placement on a subassembly, the subassembly having at least two spaced apart joists, said system comprising:

a plurality of elongated tubular elements for placement in lateral interlocking engagement with each other transversely of and spanning the distance between the joists, each of said plurality of elements having a top portion, a bottom portion, a first side wall, and a second side wall, said first and second side walls connecting said top and bottom portions;

wherein said top portion extends laterally from said second side wall beyond said first side wall, said top portion having formed thereon a downwardly extending longitudinal flange, wherein said bottom portion extends laterally from said first side wall beyond said second side wall, said bottom portion having formed thereon an upwardly extending longitudinal wall defining an upwardly opening channel between said second side wall and said longitudinal wall;

wherein said flange is defined by elongated opposing flange walls each of said flange walls having a pair of spaced apart longitudinally extending ribs; and wherein said second side wall and said longitudinal wall have a pair of cooperatively spaced apart longitudinally extending ribs adapted to engage flange wall ribs on an adjacent tubular element and form a moisture seal there along; and, a plurality of fasteners passing through said bottom portion on either side of said longitudinal wall.

3. The decking system as defined in claim 2 further comprising at least one internal wall extending between said top and bottom portion.

4. The decking system as defined in claim 3 further comprising a surface tread formed on the exterior of said top portion comprising a series of lands and crests, including parallel major and minor lands, said major lands overlying at least said first side wall and each internal wall and separated by major crests, said major crest having formed thereon said minor crests and minor lands.

5. The decking system as defined in claim 4 wherein said major crests include a pair of planar surfaces intermediate said major land and an adjacent minor land.

6. The decking system as defined in claim 5 wherein each of said plurality of elongated members is formed by extrusion from a material selected from the group including PVC, poly-ethelene-teriphathlate, and aluminum.

7. The decking system as defined in claim 2, wherein said tubular element includes a plurality of spaced-apart holes formed in said fastening portion of said channel for accommodating passage of fasteners therethrough to a supporting structure.

8. The decking system as defined in claim 2, wherein said tubular element includes a plurality of reinforcing ribs located between said side walls and interconnecting said top and bottom walls.

9. The decking system as defined in claim 2 comprising a plurality of interconnected modular construction elements assembled together on a supporting structure.

10. A decking system for placement on a subassembly, the subassembly having at least two spaced apart joists, said system comprising:

a plurality of elongated tubular elements for placement in lateral interlocking engagement with each other transversely of and spanning the distance between the joists;

each of said plurality of elements having a top portion having a proximal end and a distal end;

a bottom portion having a proximal end and a distal end;

a first side wall connecting said proximal end of said bottom portion with said top portion; and a second side wall connecting said distal end of said top portion with said bottom portion;

wherein said proximal end of said top portion extends laterally beyond said first side wall and has formed thereon a downwardly extending longitudinal flange;

wherein said distal end of said bottom portion extends laterally beyond said second side wall to form a ledge, wherein an upwardly extending longitudinal wall is attached to said distal end of said bottom portion between said second side wall and said ledge, said upwardly extending longitudinal wall defining an upwardly opening channel adjacent said second side wall adapted to receive therein in watertight relation said downwardly extending longitudinal flange;

said bottom portion having formed therein a plurality of apertures traversing said ledge and said upwardly opening channel, said apertures adapted for the selective insertion of fasteners therethrough for engagement with the joists; and, a surface tread formed on the exterior of said top portion comprising a series of longitudinally extending lands and crests including parallel major and minor lands, said major lands overlying at least said first side wall and separated by major crests, said major crest having formed thereon said minor crests and minor lands.

* * * * *